US010730094B2

(12) United States Patent
Deuerlein

(10) Patent No.: US 10,730,094 B2
(45) Date of Patent: Aug. 4, 2020

(54) MULTI-TOOL

(71) Applicant: PASS Stanztechnik AG, Creußen (DE)

(72) Inventor: Andreas Deuerlein, Egloffstein (DE)

(73) Assignee: PASS Stanztechnik AG, Creußen (DE)

( * ) Notice: Subject to any disclaimer, the term of this patent is extended or adjusted under 35 U.S.C. 154(b) by 229 days.

(21) Appl. No.: 15/570,832

(22) PCT Filed: Oct. 4, 2016

(86) PCT No.: PCT/EP2016/073676
§ 371 (c)(1),
(2) Date: Oct. 31, 2017

(87) PCT Pub. No.: WO2017/060241
PCT Pub. Date: Apr. 13, 2017

(65) Prior Publication Data

US 2018/0141100 A1 May 24, 2018

(30) Foreign Application Priority Data

Oct. 7, 2015 (DE) ..... 10 2015 219 416

(51) Int. Cl.
*B21D 28/12* (2006.01)

(52) U.S. Cl.
CPC ..... *B21D 28/125* (2013.01)

(58) Field of Classification Search
CPC ..... B21D 28/12; B21D 28/125; B21D 28/36; B21D 37/04
See application file for complete search history.

(56) References Cited

U.S. PATENT DOCUMENTS

| | | | | |
|---|---|---|---|---|
| 5,615,471 | A | 4/1997 | Perazzolo | |
| 6,074,330 | A * | 6/2000 | Ostini | B21D 28/12 483/29 |
| 2009/0211326 | A1* | 8/2009 | Laib | B21D 28/12 72/332 |
| 2011/0116881 | A1 | 5/2011 | Sonoda et al. | |

FOREIGN PATENT DOCUMENTS

| | | |
|---|---|---|
| DE | 10 2005 005214 | 8/2006 |
| DE | 10 2014 224 094 | 6/2016 |
| EP | 0 399 337 | 11/1990 |
| EP | 2 596 878 | 5/2013 |
| JP | 2008023575 | 2/2008 |
| JP | 2009 108942 | 5/2009 |
| JP | 2010017797 | 1/2010 |

* cited by examiner

*Primary Examiner* — Debra M Sullivan
(74) *Attorney, Agent, or Firm* — Boyle Fredrickson S.C.

(57) ABSTRACT

A multi-tool is a constituent part of a punch device, in particular of a turret punch press. An upper tool part has a plurality of upper tools which are activatable from a head side via a machine pusher of the punch device for workpiece-machining purposes. A lower tool part has a plurality of lower tools. A workpiece is arrangeable between the upper tool part and the lower tool part. In each case one of the lower tools interacts with an associated upper tool. The number of the upper tools is greater than the number of the lower tools. This results in a multi-tool for extending the possible uses of a punch device.

11 Claims, 15 Drawing Sheets

MULTI-TOOL

FIELD OF THE INVENTION

The invention relates to a multi-tool for a punch device, in particular for a turret punch press. The invention is also directed to a punch device having a corresponding multi-tool.

BACKGROUND OF THE INVENTION

Such multi-tools are known, for example, from EP 2 596 878 A, from U.S. Pat. No. 5,615,471, from JP 09-108942 A and from JP 2010-017797 A. A further tool is known from US 2011/0116881 A1.

DE 10 2005 005 214 A1 discloses a further multi-tool, a machine tool and a method of machining workpieces, in particular metal sheets. A multi-tool is also known from DE 10 2014 224 094 A1. JP 2008-23575 A discloses a punch device.

SUMMARY OF THE INVENTION

It is an object of the present invention to extend the possible uses of a punch device, in particular having a motor-driven and, for example, rotatable station.

This object is achieved according to the invention by providing a multi-tool including an upper tool part and a lower tool part. The upper tool part has a plurality of upper tools which are activatable from a head side via a machine pusher of the punch device for workpiece-machining purposes. The lower tool part has a plurality of lower tools. A workpiece is arrangeable between the upper tool part and the lower tool part. Each of the lower tools interacts with an associated upper tool. The number of the upper tools is greater than the number of the lower tools.

The object is further achieved according to the invention by providing a punch device having a multi-tool according to the invention.

According to the invention, it has been found that a lower tool which interacts with an upper tool is necessary or not depending on the machining task. The multi-tool according to the invention has both types of upper tools, that is to say upper tools which interact with a lower tool and upper tools which do not interact with a lower tool. In particular when the lower tools require a greater amount of installation space than the upper tools, it is then advantageously possible for more upper tools to be accommodated in the upper tool part.

The upper tools can be prestressed axially by springs in each case in a rest position, which counteracts the actuation by the machine pusher. This avoids the situation where upper tools which have not been selected subject the workpiece to their weight and leave behind undesired markings there.

It is, of course, possible, despite a smaller number of lower tools, to ensure that each upper tool of the multi-tool interacts with one of the lower tools. However, this requires movement of the lower tool part relative to the upper tool part along a further degree of freedom. A configuration, in which at least one of the upper tools does not interact with a lower tool, avoids the need for such further relative displacement.

Punching tools, in which the upper tools, which interact with, in each case, one of the lower tools, are configured in the form of punching tools, and stamping tools, in which the upper tools, which do not interact with a lower tool, are configured in the form of stamping tools, have been found to be particularly suitable as upper tools for the multi-tool. The stamping tool may be an engraving needle. The upper tool which does not interact with a lower tool, in particular the stamping tool, may be a tool with a machining part which is spring-mounted via a compensating spring, in particular with a stamping part which is spring-mounted via a compensating spring. As an alternative, the upper tool which does not interact with a lower tool may be a tool for providing signatures or for countersinking or marking purposes.

The multi-tool may have a plurality of upper-tool types which interact with a lower tool and/or a plurality of upper-tool types which do not interact with a lower tool.

At least one of the upper tools, or also all of the upper tools, can be retained in the upper tool part by means of a quick-change holder. In particular the upper tools which do not interact with a lower tool can thus be configured for quick-change purposes. This is advantageous, for example, when the intention is to change over quickly between a stamping tool and an engraving tool.

A projection of the upper tools which do not interact with a lower tool, in which the upper tools which do not interact with a lower tool project on the head side, and in a direction of the machine pusher of the punch device, beyond a rest of the upper tool part, allows activation of the upper tool, i.e. generation of a projection of a stamping part of the upper tool beyond the rest of the upper tool part, with the aid of a machine pusher with a planar actuating wall.

An encircling arrangement of the upper tools, in which the upper tools are arranged to encircle a longitudinal axis of the multi-tool in a circumferential direction, wherein an upper tool which does not interact with a lower tool is arranged circumferentially between two upper tools, which interact with in each case one of the lower tools, makes it easier for the respective upper tool to be selected via the machine pusher. It is possible here for upper tools which do not interact with a lower tool to be arranged in an alternating manner in each case with upper tools which interact with a lower tool.

The multi-tool may have, for example, eight upper tools and four lower tools. A different number of upper tools ranging between two upper tools and twenty upper tools is also possible. The number of lower tools can range between one lower tool and, for example, sixteen lower tools.

The advantages of a punch device having a multi-tool according to the invention correspond to those which have already been explained above with reference to the multi-tool.

A pusher arrangement, in which the machine pusher of the punch device interacts simultaneously with a central upper-tool-part pusher and with in each case one of the upper tools on the head side, makes it possible for the machine pusher to introduce force advantageously centrally onto the upper tool part. Axial displacement in any case of a housing portion of the upper tool part to the lower tool part can take place by actuation of the upper-tool-part pusher by the machine pusher of the punch device counter to the spring force of an upper-tool-part retaining spring. This makes it possible for a central tool-housing portion of the upper tool part to be displaced relative to a machine-mounted outer annular tool-housing portion of the upper tool part.

A spring support, in which the central upper-tool-part pusher is supported counter to an actuating direction of the machine pusher via a central pusher spring, is likewise advantageous in respect of force being introduced centrally into the multi-tool.

Peripheral pusher spring mounting, in which the upper-tool-part pusher is supported counter to the actuating direction of the machine pusher via a plurality of peripheral pusher springs, counteracts a tendency to tilt upon guiding the pushers and/or the tools in the upper tool part.

It is advantageous if the pusher pivoting drive is configured such that it is activatable independently of the multi-tool pivoting drive.

The features of such a punch device can be combined with additional features which have been explained above with reference to the multi-tool. Such a punch device is capable of increasing variability as far as use of the tools of the multi-tool is concerned, in particular in the case of tools which are configured not to be rotationally symmetrical about an individual tool axis.

It has also been found that a pivoting capability of the machine pusher, on the one hand, and of the multi-tool, on the other hand, makes it possible, on the one hand, to select a tool via the machine pusher and on the other hand, to predetermine orientation of the selected tool in relation to the workpiece as seen in respect of the longitudinal axis of the selected tool. In the case of tools which are to be selected and have a cross-sectional contour which is not rotationally symmetrical in relation to the individual longitudinal axis of the tool, this pivoting capability of the machine pusher, on the one hand, and multi-tool, on the other hand, makes it possible, via the predetermined orientation, to reduce the number of tools which have to be provided in the multi-tool.

The machine pusher has a cross-sectional peripheral contour which is not rotationally symmetrical when an actuating portion of the machine pusher, which comes into contact with the upper tools, has a cross-sectional peripheral contour which is similarly not rotationally symmetrical. The rotationally symmetrical peripheral contours here are only those which, upon any desired rotation about the pusher axis, merge into the other. It is also the case here that a cross-sectional peripheral contour of the actuating portion of the machine pusher with an N-fold symmetry, for example a two-fold, three-fold or four-fold symmetry, is a peripheral contour which differs from a rotational symmetry.

BRIEF DESCRIPTION OF THE DRAWINGS

An exemplary embodiment of the invention will be explained in more detail hereinbelow with reference to the drawing.

DESCRIPTION OF AT LEAST ONE PREFERRED EMBODIMENT

Figure 1:
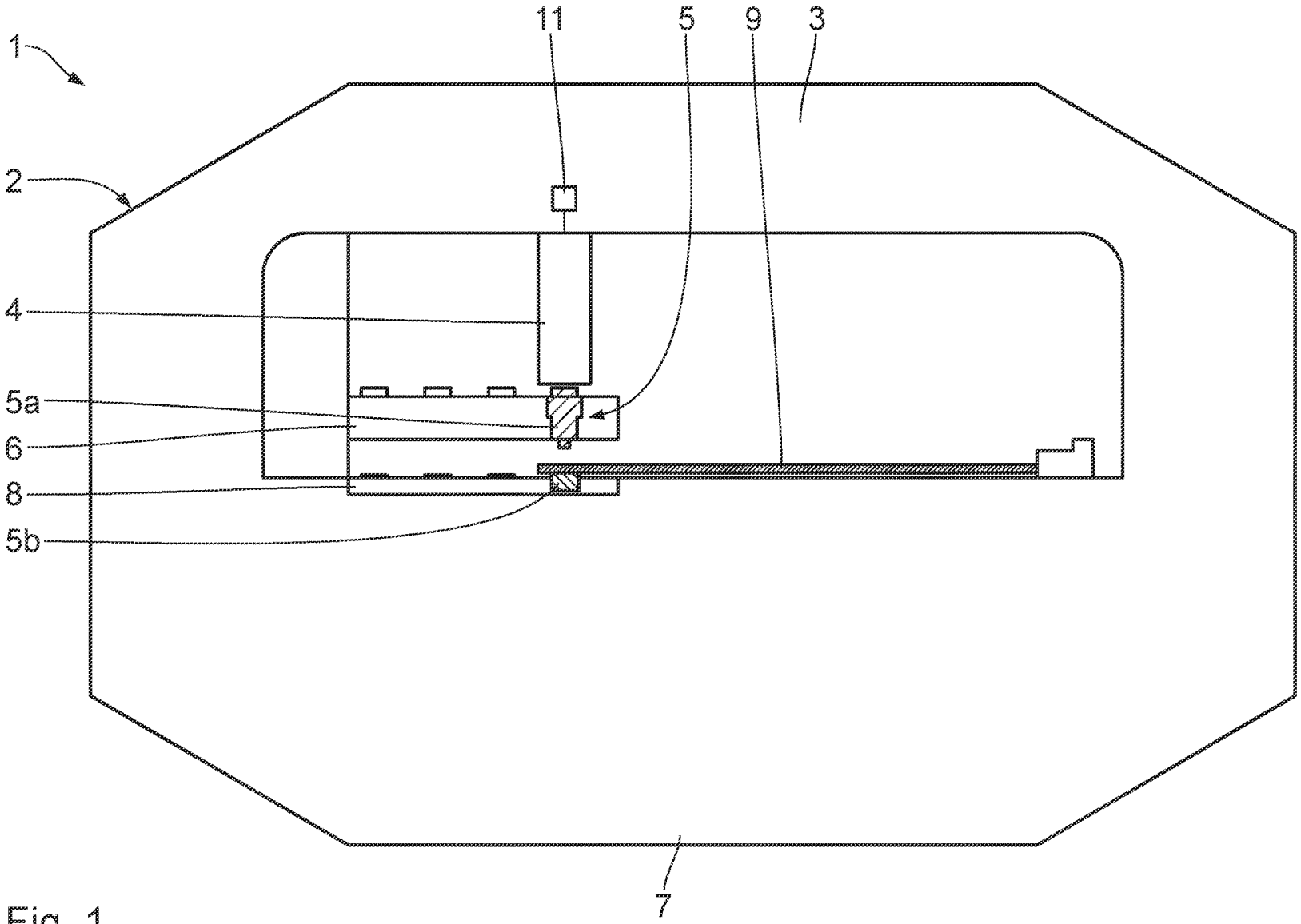
FIG. 1 shows a side view of a schematically illustrated punch device having a multi-tool according to the invention.

A punch device 1, which is shown in its entirety in FIG. 1, comprises a framework or a frame 2, on the upper framework part 3 of which is fitted an actuating or machine pusher 4. Beneath the actuating pusher 4, an upper tool part 5*a* of a multi-tool 5 is arranged typically in a turret, in an upper turret holder 6. A lower tool part 5*b* in the form of a die is located on the lower part 7 of the framework 2, and is retained by a lower turret holder 8. A workpiece 9 which is to be machined, in this way a metal sheet, is located between the upper tool part 5*a* and the lower tool part 5*b*. The workpiece 9 may be a sheet-metal panel.

Figure 2:
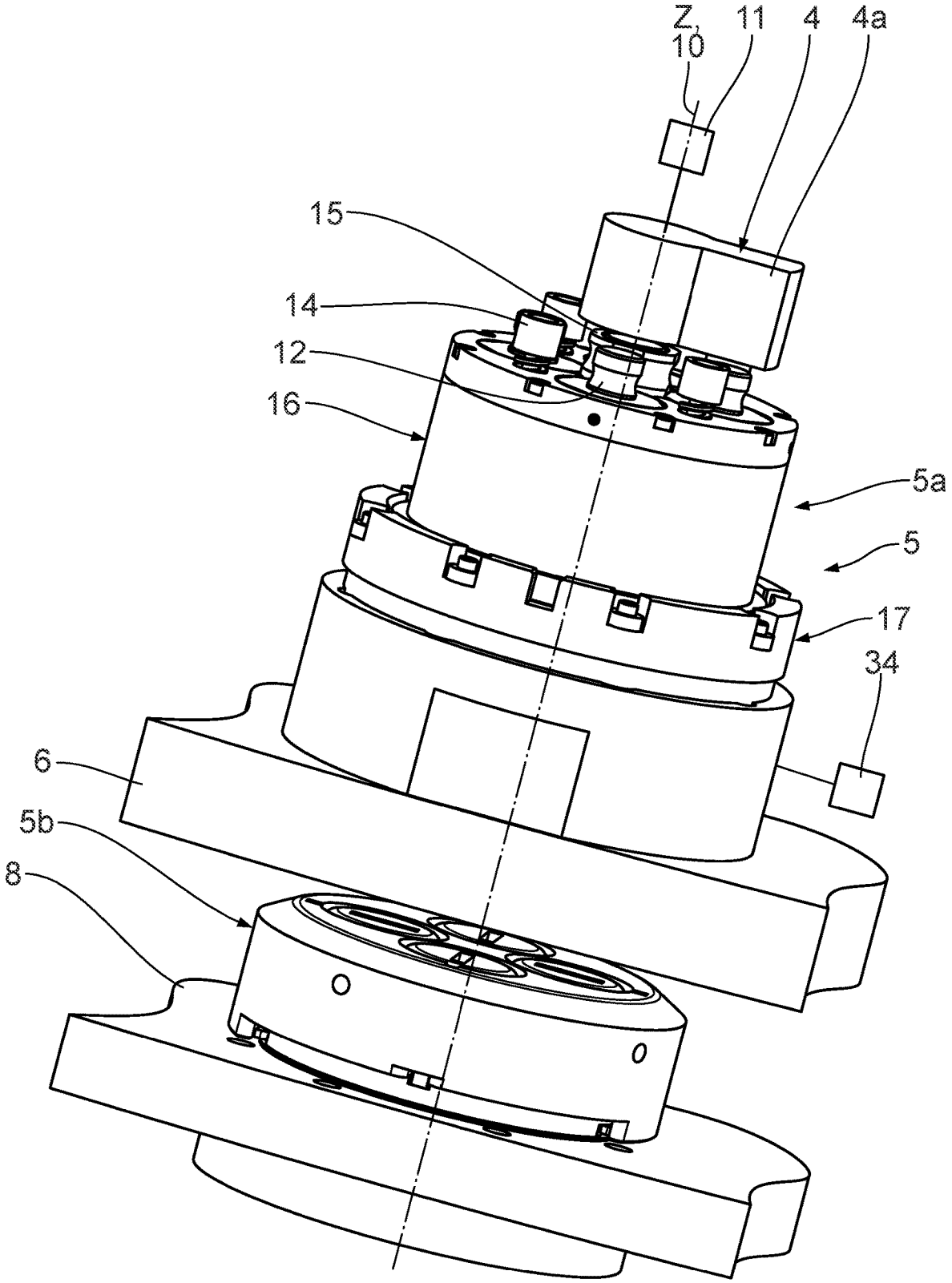
FIG. 2 shows, in perspective, the multi-tool with punch-device-side components, that is to say retaining components for an upper tool part and a lower tool part of the multi-tool and for a machine pusher of the punch device for selecting an upper tool which is to be actuated, wherein the machine pusher of the punch device has selected for actuation an upper tool in the form of a punching tool.
Figure 3:
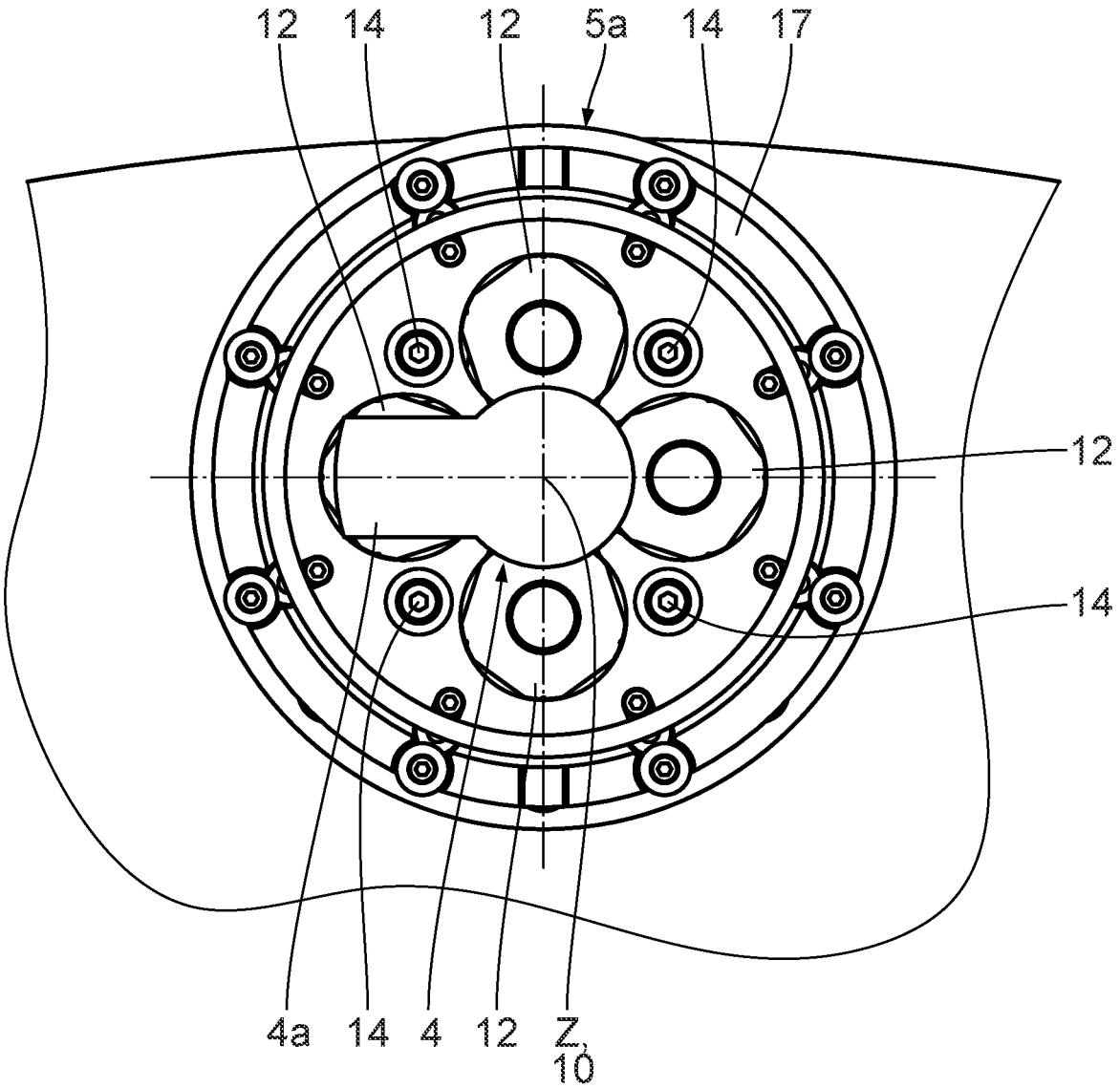
FIG. 3 shows a plan view of the multi-tool with the punch-device-side components according to FIG. 2.
Figure 4:
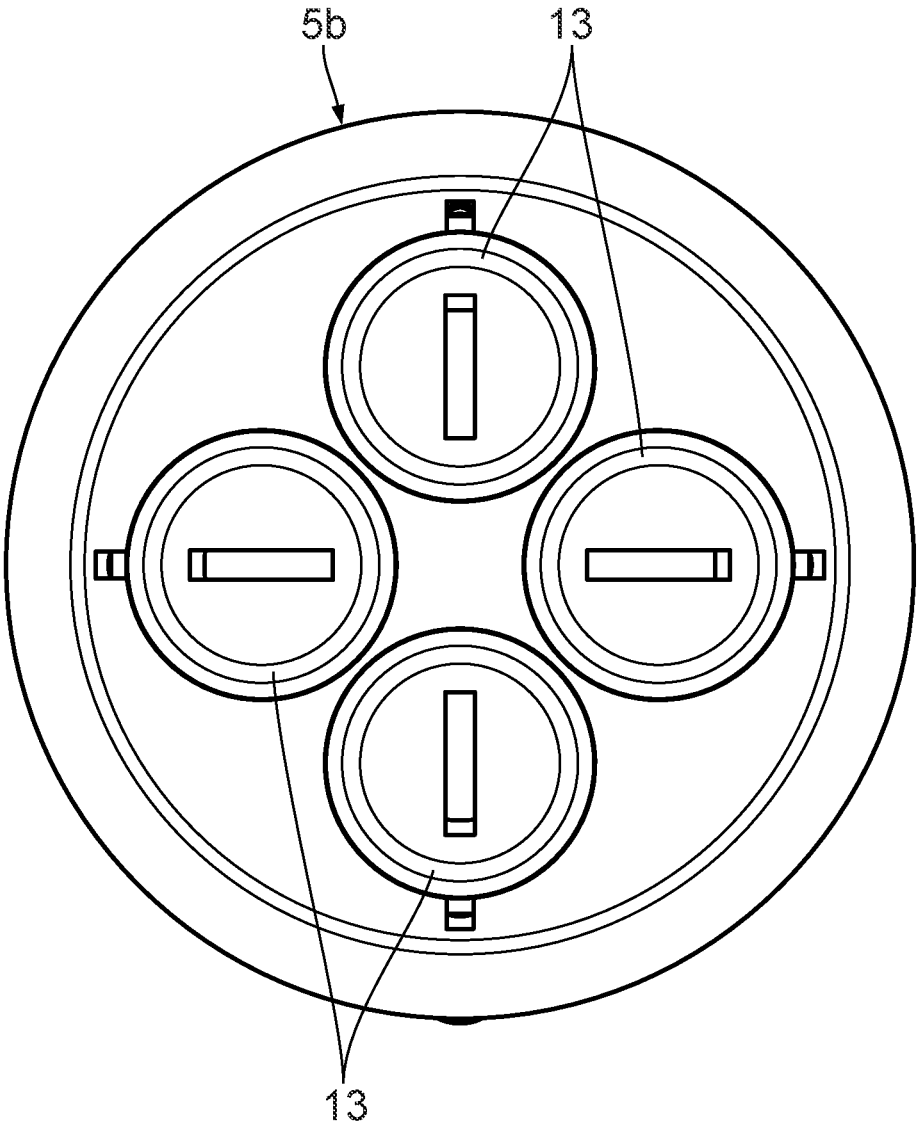
FIG. 4 shows a plan view of the lower tool part of the multi-tool.

FIG. 2 shows a perspective view of the multi-tool with selected punch-device-side components, that is to say with cut-away portions of the two turret holders 6 and 8 and with an actuating-side portion 4*a* of the machine pusher 4, said portion being directed toward a head side of the multi-tool 5. As can be gathered from the plan view according to FIG. 3, the actuating portion 4*a* has a keyhole-shaped cross section, wherein a center Z of an eye of said keyhole cross section of the actuating portion 4*a* coincides with a central longitudinal axis 10 of the multi-tool 5. It is therefore the case that the machine pusher 4, in a direction perpendicular to the pusher axis coinciding with the longitudinal axis 10, has a cross-sectional peripheral contour which differs from a rotational symmetry.

A foot region of the keyhole cross section of the actuating portion 4*a* extends radially outward from said center Z. The actuating portion 4*a* of the machine pusher 4 is driven for pivoting or rotation about the pusher axis 10. This is ensured by a pusher pivoting or rotary drive 11, which is indicated schematically in FIG. 1. As an alternative, or in addition, it is possible for the upper tool part 5*a*, instead of the actuating portion 4*a*, to be configured such that it is driven for pivoting or rotation about the longitudinal axis 10.

The upper tool part 5*a* has retained in it a plurality of upper tools which are activatable from the head side of the multi-tool 5 via the machine pusher 4 of the punch device 1 for the purpose of machining the workpiece 9. A plurality of lower tools are retained in the lower tool part 5*b*. For workpiece-machining purposes, the workpiece 9 is arranged between the upper tool part 5*a* and the lower tool part 5*b*, as illustrated in FIG. 1.

During workpiece machining, in each case one of the lower tools interacts with an associated upper tool, if the latter has been selected.

The upper tools in the upper tool part 5*a* belong to two upper-tool types. Four of the total of eight upper tools in the upper tool part 5*a* interact with in each case one lower tool. These upper tools which interact with the lower tools are punching tools 12. The associated lower tools are dies 13. Four more of the upper tools do not interact with a lower tool and are configured in the form of stamping tools 14. The number of upper tools 12, 14, that is to say eight upper tools, is greater than the number of lower tools 13, that is to say four lower tools. The stamping tools 14 do not interact with a lower tool.

The upper tools 12, 14 are arranged to encircle the longitudinal axis 10 in circumferential direction, wherein a punching tool 12 and a stamping tool 14 follow one after the other in each case in an alternating manner. The total of eight upper tools 12, 14 are distributed equally about the longitudinal axis 10 in the circumferential direction that is to say they are spaced apart from one another at a circumferential angle of 45°.

The upper tool part 5*a*, in addition, has a central upper-tool-part pusher 15. In each rotary selection position, the machine pusher 4 of the punch device 1 interacts with the central upper-tool-part pusher 15 and simultaneously with in each case one of the upper tools 12, 14 on the head side. In the case of the embodiment illustrated, a total of eight rotary selection positions are therefore possible for the actuating portion 4*a* of the machine pusher 4 relative to the upper tool part 5*a*.

The upper tool part 5*a*, for its part, is subdivided between a central tool-housing portion 16, which is retained in radial direction in an encircling annular tool-housing portion 17.

A punching operation will be described hereinbelow with reference to FIGS. 5 to 9. The actuating portion 4*a* of the machine pusher 4 here is present in one of four possible rotary selection positions, in which it overlaps with a pusher head 18 of one of the punching tools 12 and can interact therewith.

Figure 5:
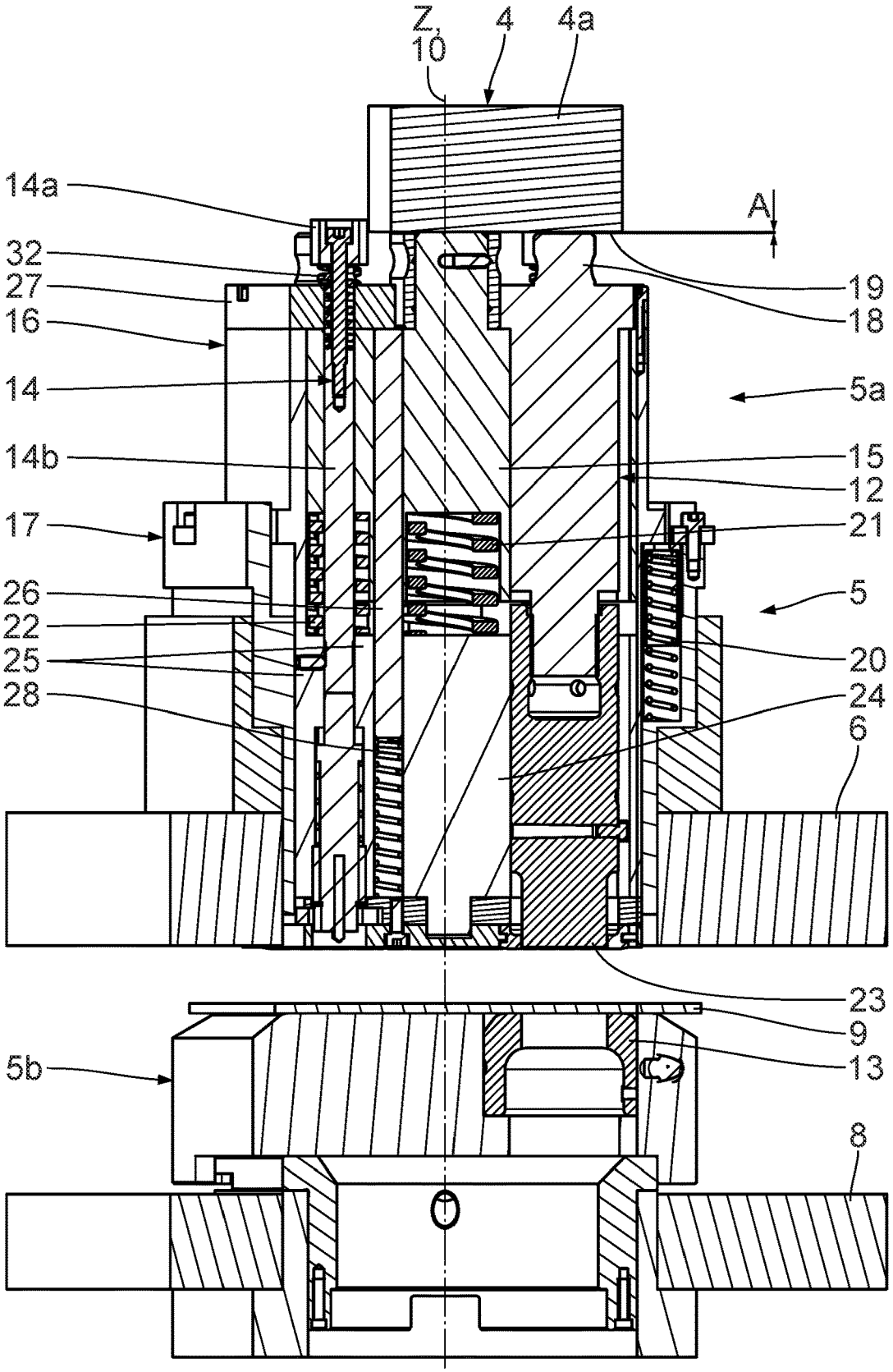
FIGS. 5 to 9 each show, in an axial longitudinal section, instantaneous positions of the multi-tool and of the punch-device-side components during the punching operation, that is to say with use being made of an upper tool in the form of a punching tool.

In the instantaneous position according to FIG. 5, the machine pusher 4 has been lowered axially in the direction of the multi-tool 5 to the extent where the actuating portion 4*a* is positioned on a head of the central upper-tool-part pusher 15. A small distance A of a few tenths of a millimeter is then still present between an actuating wall 19 of the actuating portion 4*a* and the pusher head 18. The central upper-tool-part pusher 15 therefore projects beyond the four pusher heads 18 of the punching tools 12 by said small distance A.

Figure 6:
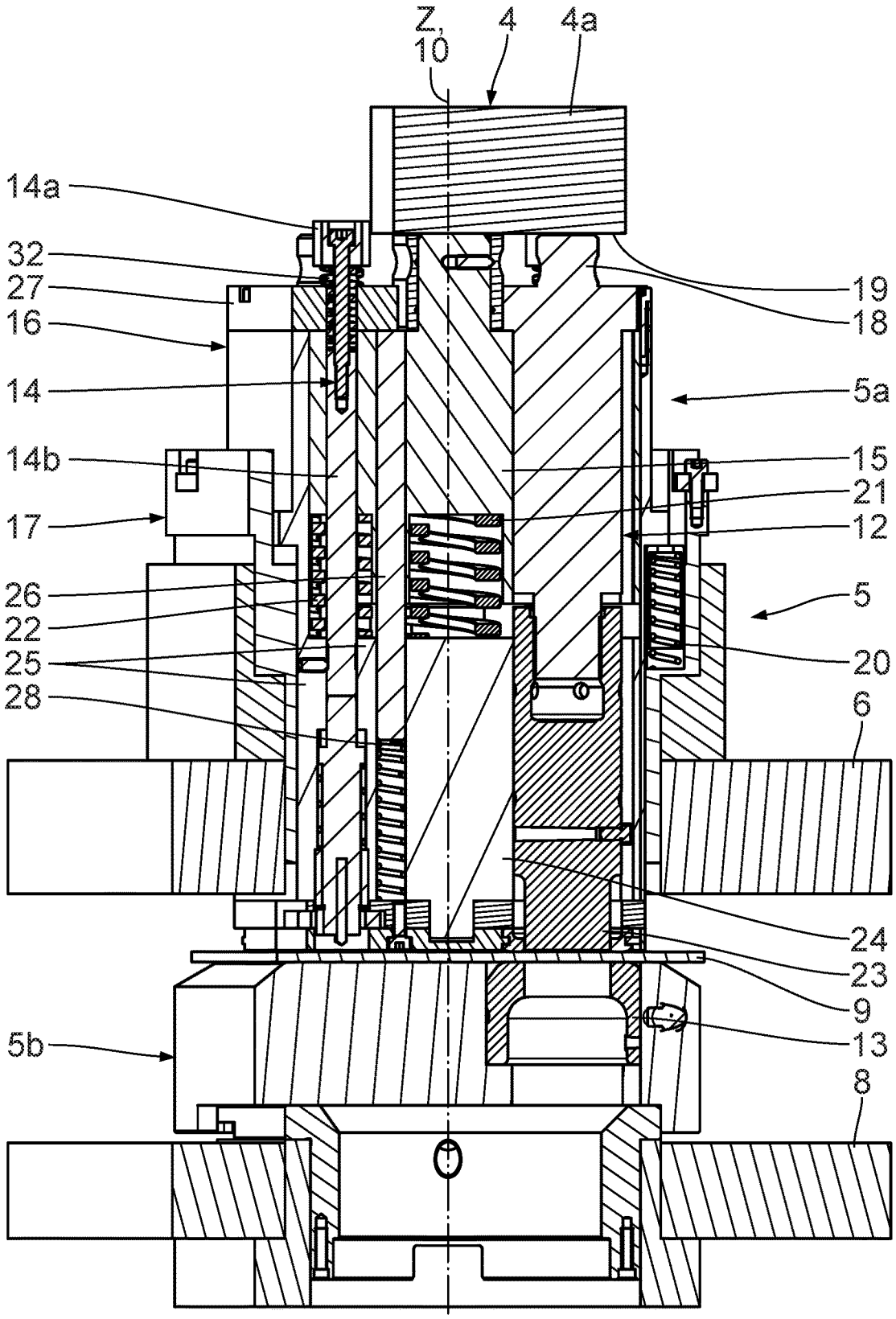

In the instantaneous position according to FIG. 6, the actuation by the actuating portion 4*a* has displaced the central tool-housing portion 16 axially downward relative to the annular tool-housing portion 17. It is still the case that there is no contact between the actuating portion 4*a* and the associated pusher head 18. The axial displacement of the housing portions 16, 17 relative to one another takes place counter to the prestressing of a total of eight upper-tool-part retaining springs 20, which are configured in the form of axially extending helical springs and are supported between the two housing portions 16, 17. The eight upper-tool-part retaining springs 20 are distributed equally in circumferential direction about the longitudinal axis 10 of the multi-tool 5. In the instantaneous position according to FIG. 6, the upper tool part 5*a*, to the extent where it is displaced downward with the central tool-housing portion 16, is positioned in its entirety on the workpiece 9. The workpiece 9 therefore delimits the axial displacement of the upper tool part 5*a* in the instantaneous position according to FIG. 6.

Figure 7:
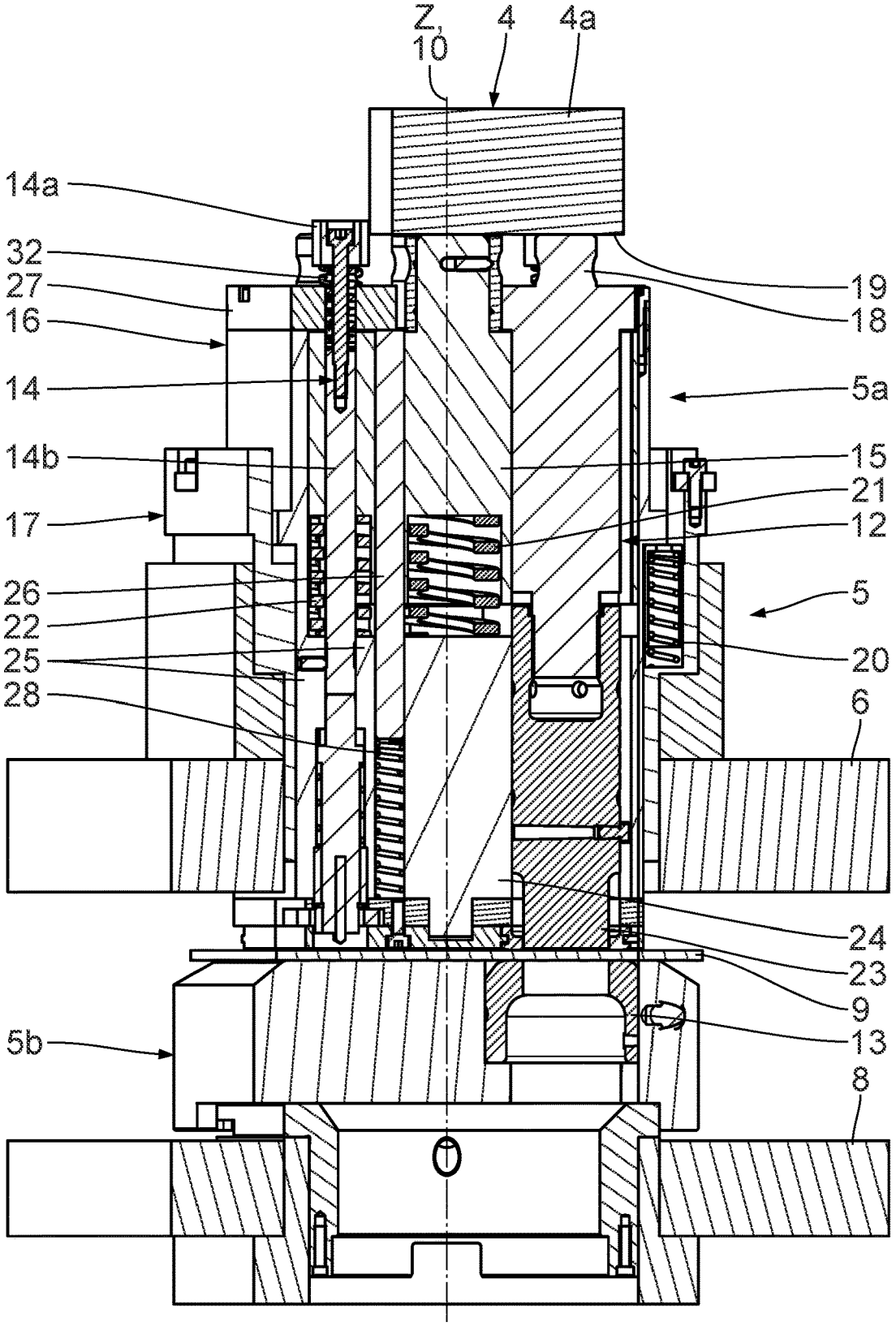

FIG. 7 shows the position in which the actuating wall 19 of the actuating portion 4*a* of the machine pusher 4 is positioned on the pusher head 18 of the selected punching tool 12. The central upper-tool-part pusher 15 has been displaced downward by the distance A relative to the punching tools 12 in comparison with FIG. 6.

Figure 8:
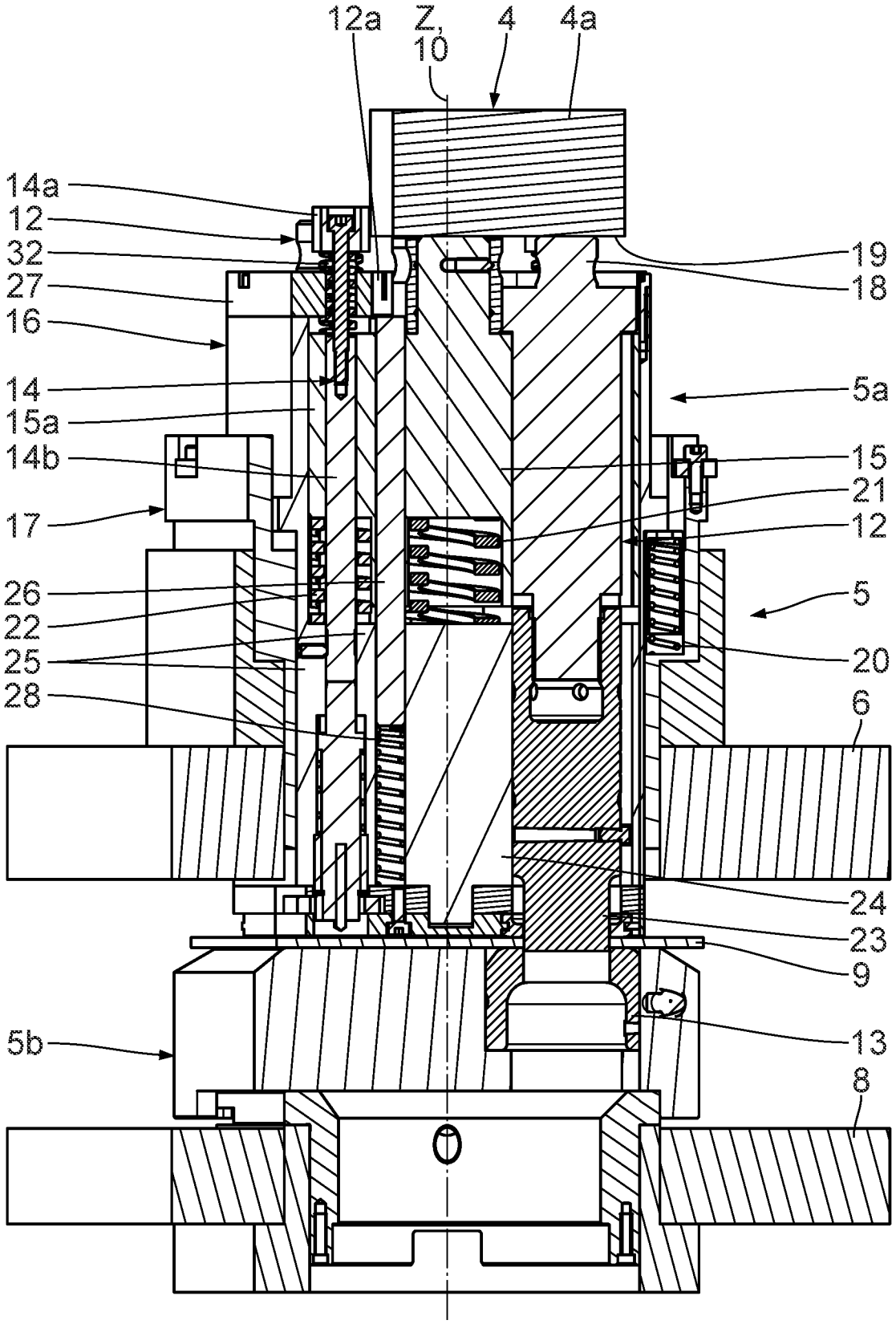

FIG. 8 shows the actual punching instantaneous position during the punching operation. The actuating portion 4*a* of the machine pusher 4 has been displaced axially downward to a greater extent in comparison with FIG. 7. The selected punching tool 12 and the central upper-tool-part pusher 15 have been displaced axially downward to a greater extent counter to the prestressing of a central pusher spring 21 and a total of four peripheral pusher springs 22, which are distributed equally in circumferential direction about the longitudinal axis 10. A punching part 23 of the punching tool 12 here passes through the workpiece 9 and, in interaction with the die 13, punches a portion of desired shape out of the workpiece 9.

The central pusher spring 21 is supported between the central upper-tool-part pusher 15 and a central housing core 24 of the central tool-housing portion 16. The peripheral pusher springs 22 are supported between peripheral housing parts 25 of the central tool-housing portion 16 and peripheral portions 15*a* of the central upper-tool-part pusher 15.

In the instantaneous punching position according to FIG. 8, the three non-selected punching tools 12 are retained in their axially upper neutral position by associated restraining bolts 26, so that they do not subject the workpiece 9 to their weight. One of these restraining bolts 26 is shown, in the section of FIG. 8, in interaction with a circumferential collar 12*a* of one of the non-selected punches 12. In order for this interaction to be shown clearly, a portion of a housing cover 27 of the central tool-housing portion 16 has been removed in the section of FIG. 8, this rendering a portion of the circumferential collar 12*a* clearly visible.

The restraining bolt 26 is prestressed in the upper restraining position via a helical spring 28. During the punching operation, the restraining bolt 26 of the selected punching tool 12 is displaced downward relative to the workpiece 9, counter to the prestressing of the restraining spring 28, with the selected punching tool.

Figure 9:
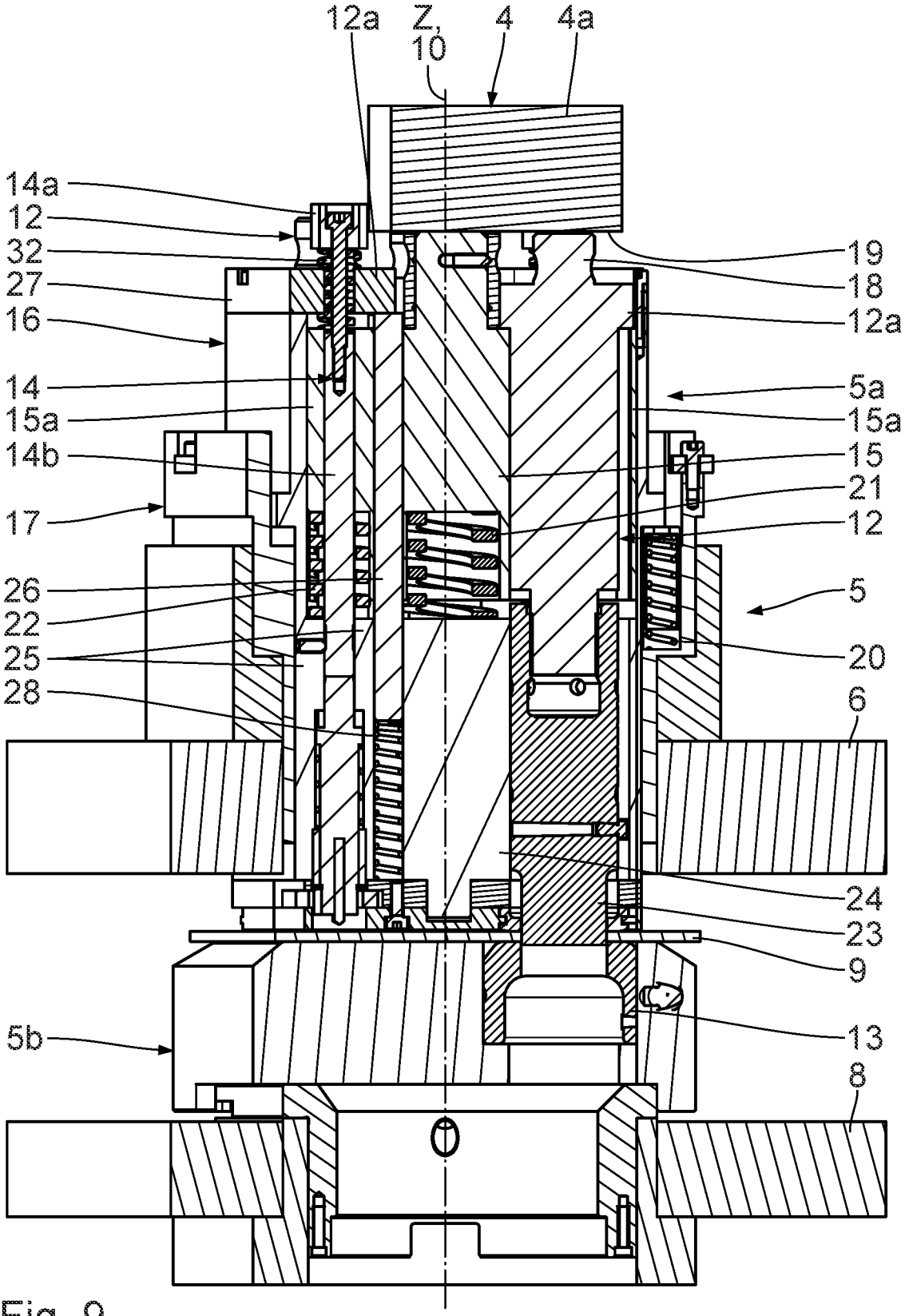

FIG. 9 shows the beginning of the return of the machine pusher 4 into the starting position prior to the punching operation. The actuating portion 4*a* of the machine pusher 4 here is losing contact again with the pusher head 18 of the selected punching tool 12. On account of the central pusher spring 21, the central upper-tool-part pusher 15 still remains in contact with the actuating portion 4*a*. Via the circumferential collar 12*a*, which has the central upper-tool-part pusher 15 engaging behind it, the selected punching tool 12 is pulled out of the workpiece 9 in upward direction as the central upper-tool-part pusher 15 returns. It is also the case that the peripheral portions 15*a* of the upper-tool-part pusher 15 engage behind the circumferential collar 12*a* of the selected punching tool 12 and counteract tilting of the punching tool 12 in the central tool-housing portion 16 as it is retrieved from the workpiece 9.

Figure 10:
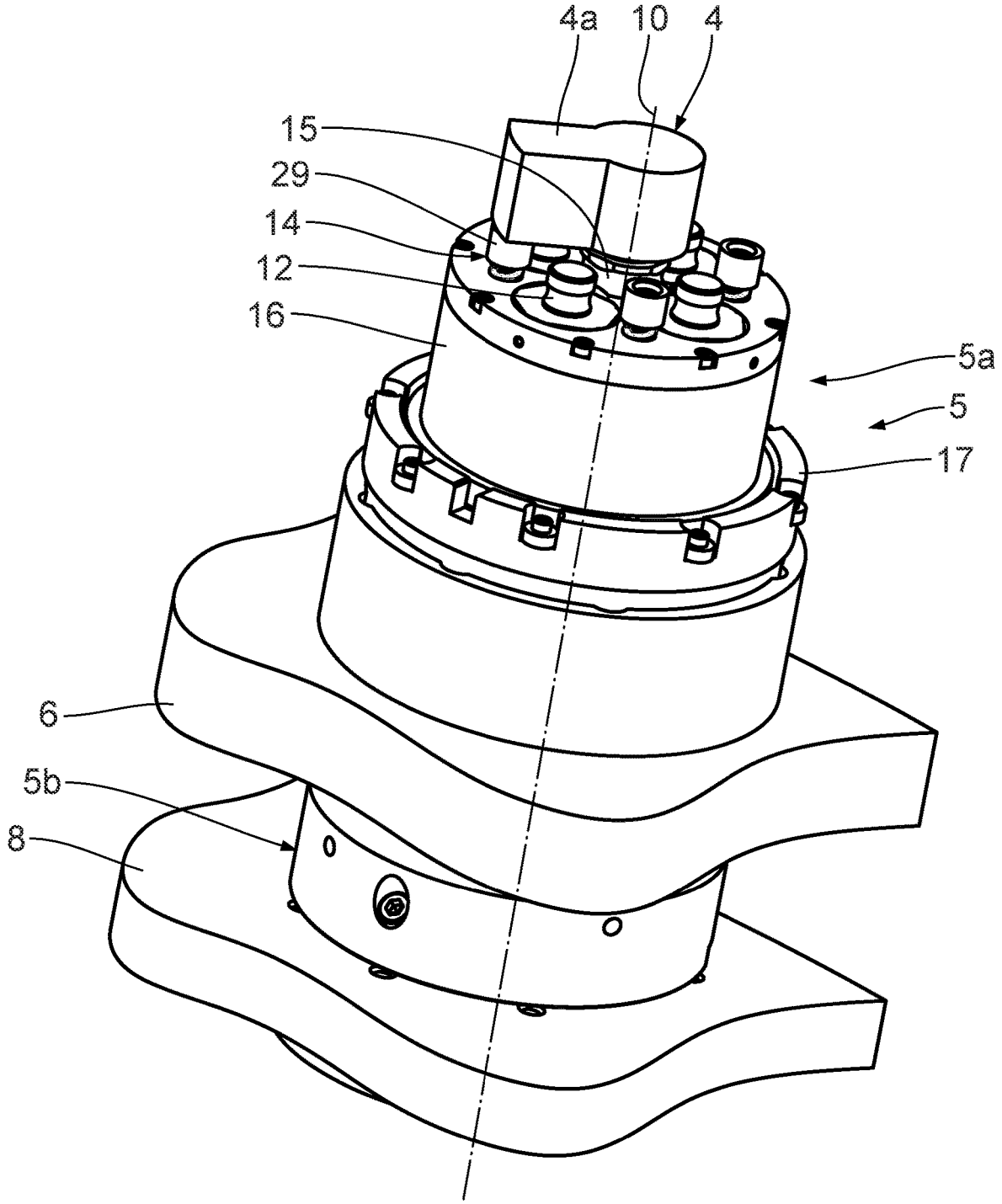
FIG. 10 shows the multi-tool with the punch-device-side components in an illustration similar to FIG. 2, wherein the machine pusher of the punch device has selected for actuation an upper tool in the form of a stamping tool.

FIG. 10 shows a relative position of the actuating portion 4*a* of the machine pusher 4 and the upper tool part 5*a* during the stamping operation, that is to say during actuation of one of the stamping tools 14. The actuating portion 4*a* of the machine pusher 4 here is present in one of four possible rotary selection positions, in which it overlaps with a head 29 of one of the stamping tools 14 and can interact therewith.

The stamping operation will be described hereinbelow with reference to FIGS. 11 to 15.

Figure 11:
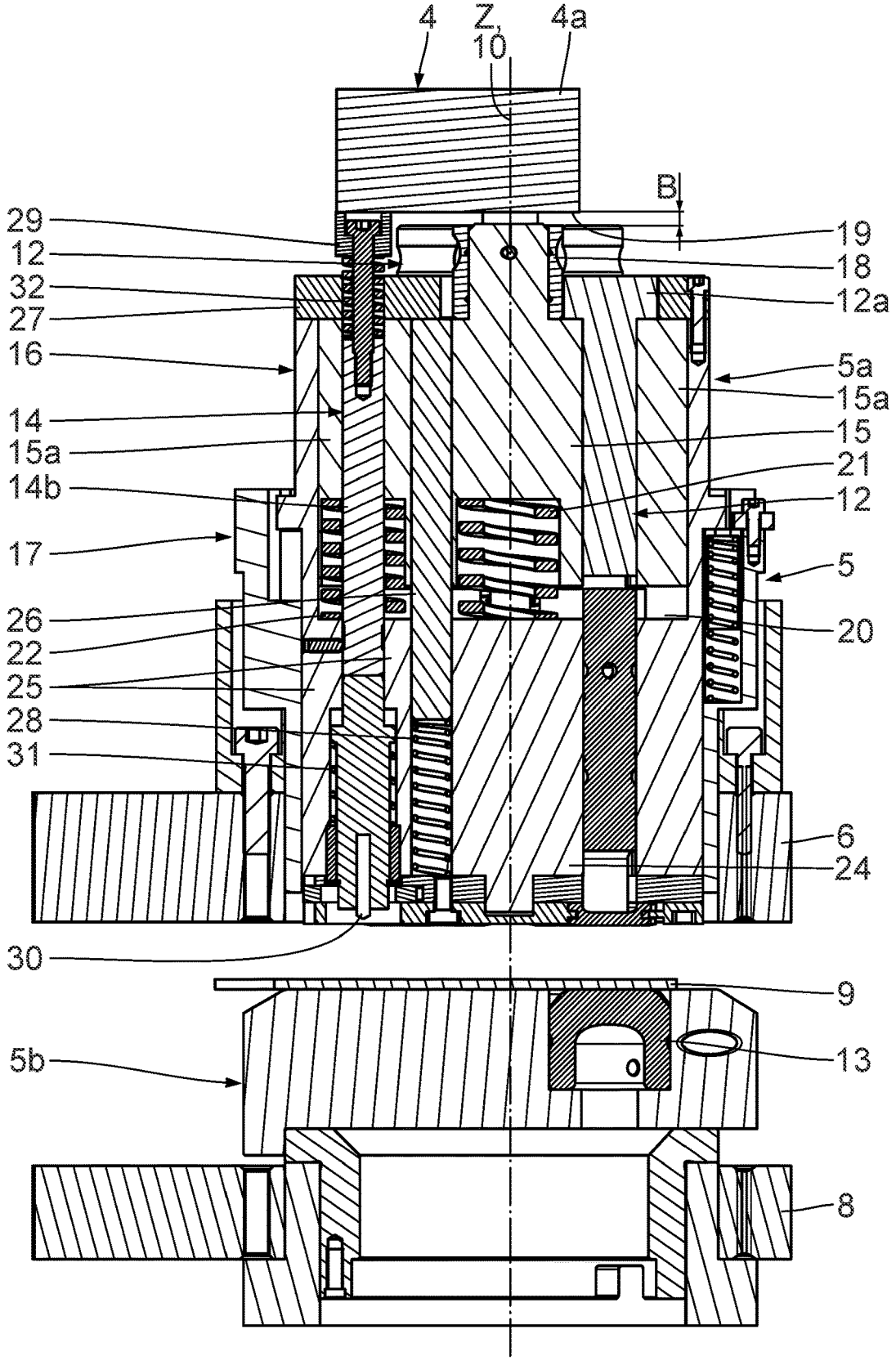
FIGS. 11 to 15 show, in illustrations similar to FIGS. 5 to 9, instantaneous positions with use being made of an upper tool in the form of a stamping tool, that is to say during the stamping operation.

FIG. 11 shows the instantaneous starting position of the stamping operation, in which the actuating portion 4*a* of the machine pusher 4 is positioned on the head 29 of the selected stamping tool 14. The heads 29 of the stamping tools 14 project axially both beyond the pusher heads 18 of the punching tools 12 and beyond the central upper-tool-part pusher 15. The projection beyond the central upper-tool-part pusher 15 means that, in FIG. 11, a distance B of approximately 1 mm to 10 mm remains between the actuating wall 19 of the actuating portion 4*a* and the central upper-tool-part pusher 15.

Figure 12:
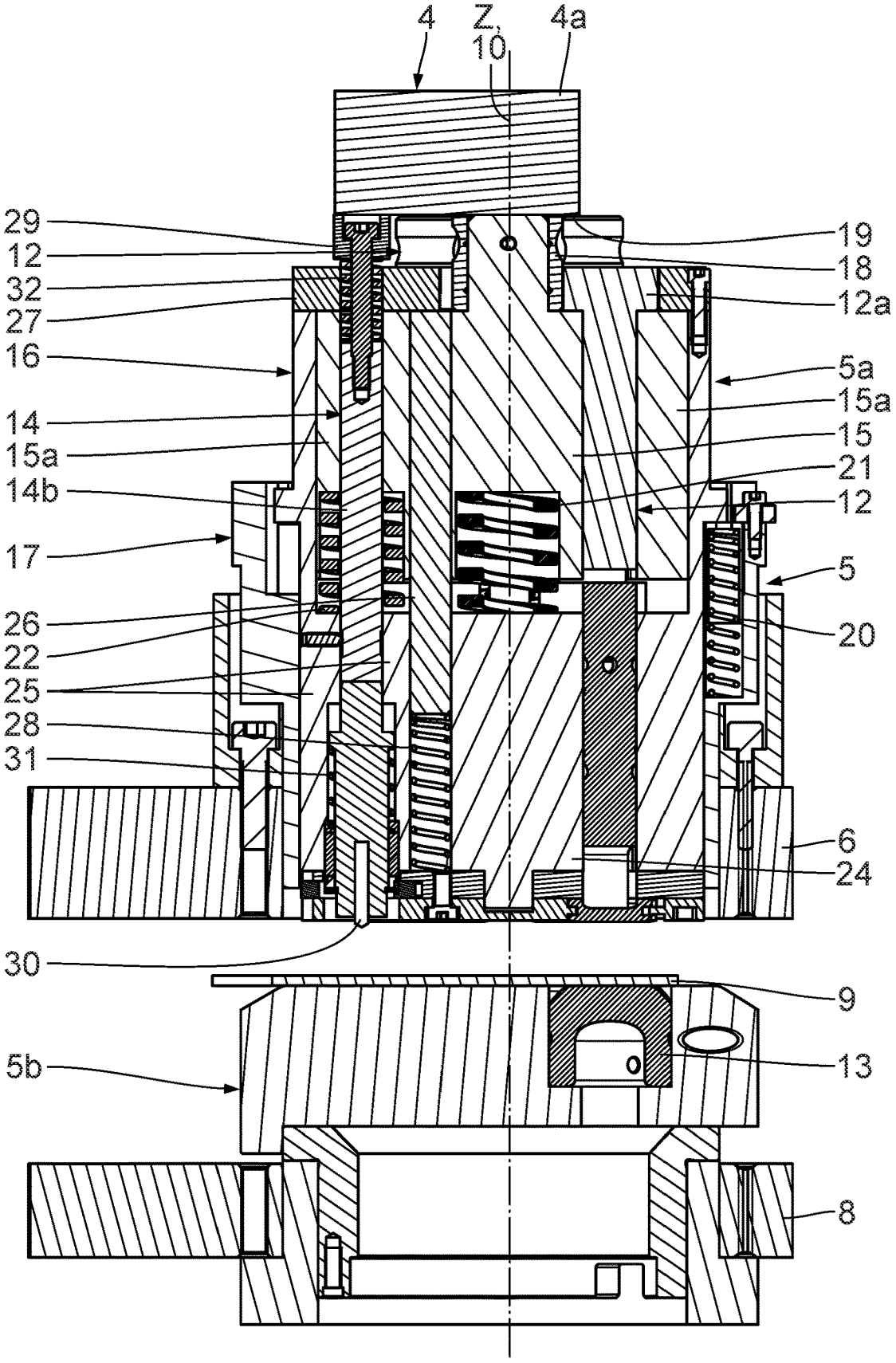

FIG. 12 shows the instantaneous position in which the actuating portion 4*a* has been lowered axially to the extent where it is positioned on the central upper-tool-part pusher 15. The selected stamping tool 14 here has been displaced downward in axial direction relative to the other components of the upper tool part 5*a* such that a stamping part 30 of the selected stamping tool 14 projects beyond an underside of the upper tool part 5*a* by a desired amount, that is to say by at most the distance B.

Figure 13:
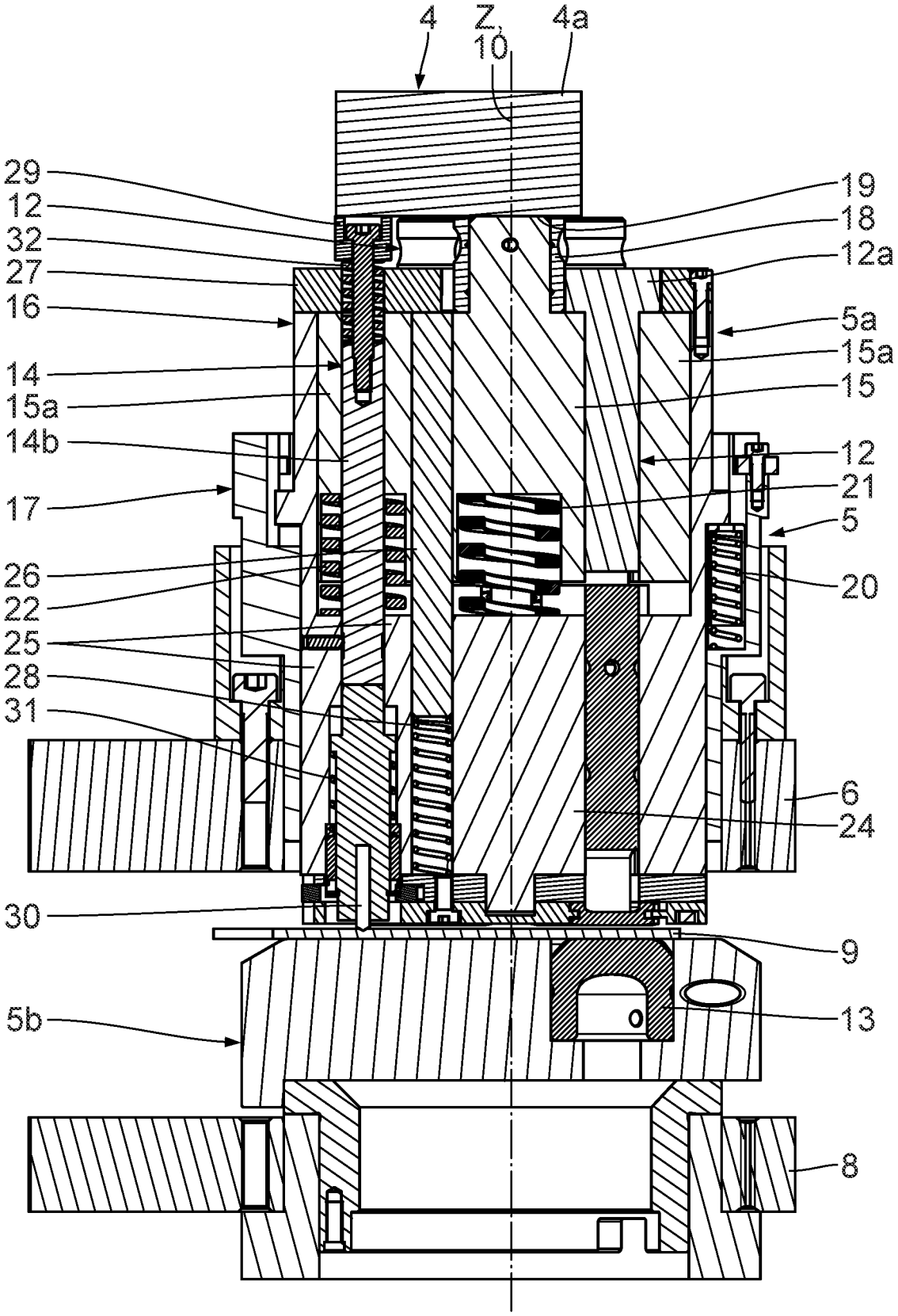

FIG. 13 shows the instantaneous position in which the actuating portion 4*a* has been displaced axially downward to a greater extent and, in a manner similar to FIG. 6, the entire central tool-housing portion 16 has been displaced downward in axial direction relative to the annular tool-housing portion 17, that is to say in direction of the workpiece 9. When positioning on the workpiece 9 takes place, in this instantaneous position according to FIG. 13, the stamping part 30, which in the embodiment shown is configured in the form of an engraving needle, engages in the workpiece 9.

The displacement of the stamping tool 14 between the instantaneous positions according to FIGS. 11 and 12 takes place counter to the prestressing of a restoring spring 31. The restoring spring 31 is arranged in the foot region of the stamping tool 14, in axial vicinity of the stamping part 30, and is supported between a circumferential collar of the stamping tool 14 and a base of the central tool-housing portion 16. The restoring springs 31 of the other, non-selected stamping tools 14 ensure that said non-selected stamping tools 14 remain in the axial upper neutral or rest position.

Moving the workpiece 9 relative to the stamping part 30 in lateral direction, that is to say in the two degrees of freedom perpendicular to the longitudinal axis 10, then makes it possible for a desired pattern to be stamped into the workpiece 9 via the stamping part 30.

Figure 14:
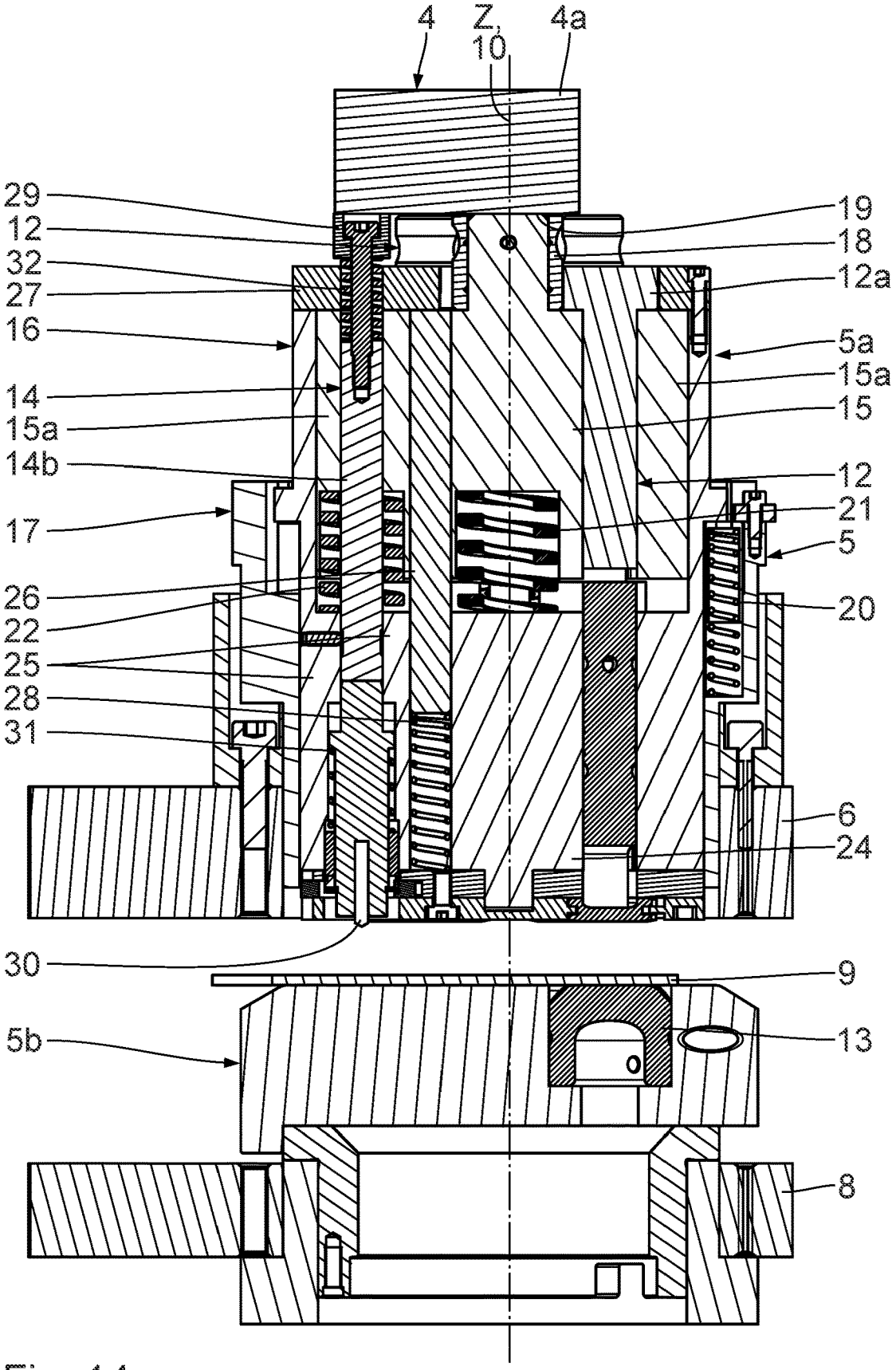

FIG. 14 shows the operation of the upper tool part 5*a* being raised up from the workpiece 9 once stamping has taken place. The instantaneous position according to FIG. 14 corresponds to that according to FIG. 12.

Figure 15:
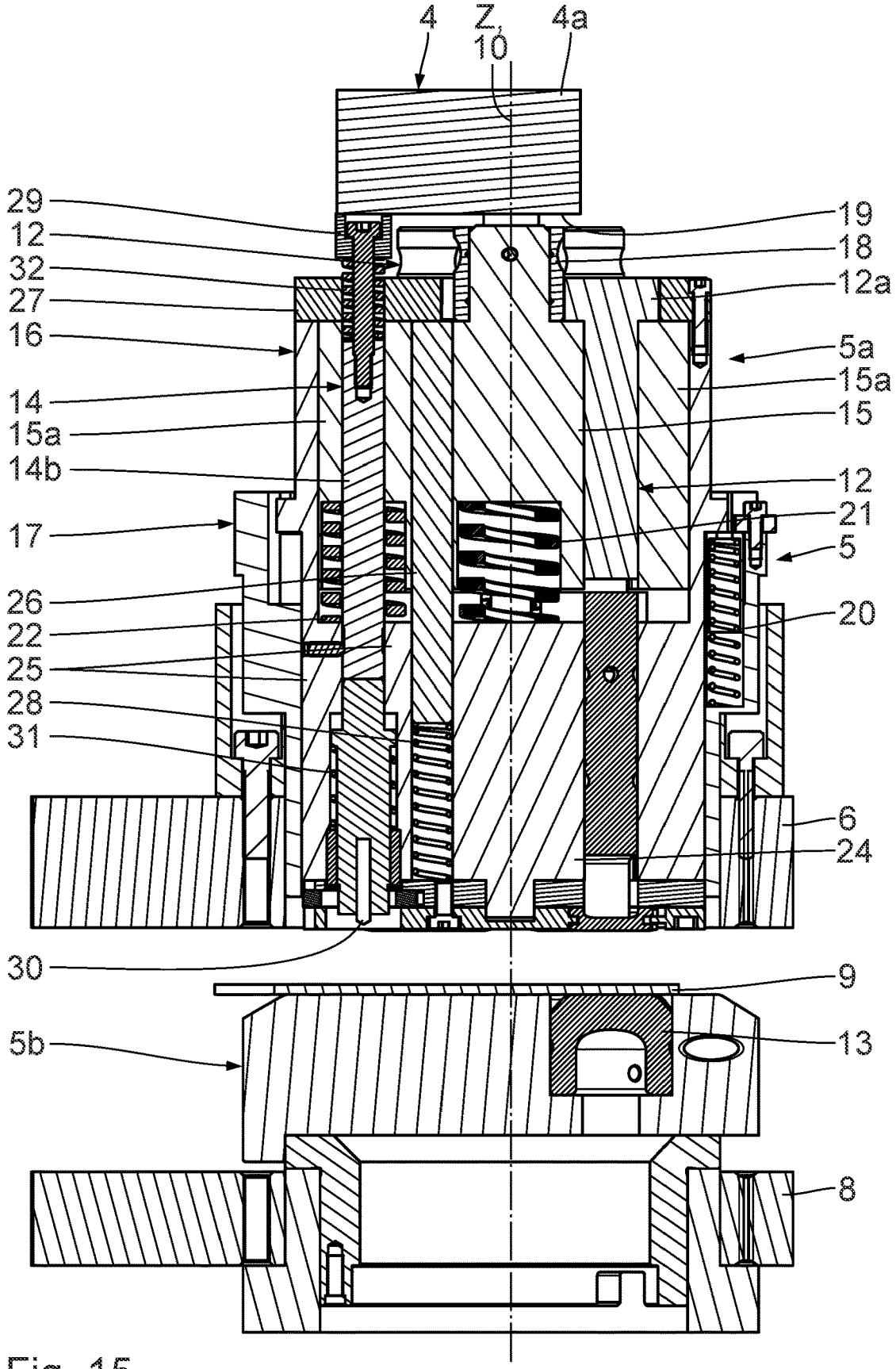

FIG. 15 shows the completion of the stamping operation. The actuating portion 4*a* of the machine pusher 4 has been raised up from the central upper-tool-part pusher 15 and the selected stamping tool 14, on account of the prestressing of the restoring spring 31, has been returned again into the neutral position, in which the stamping part does not project beyond the underside of the upper tool part 5*a*.

A head 29 of each of the stamping tools 14 has arranged beneath it a compensating spring 32, which encloses a head-end portion of the stamping tool. Said compensating spring is supported between the respective head 29 and a main body 14*b* of the stamping tool 14. The compensating spring 29 makes it possible to compensate for unevennesses of the workpiece 9 during the stamping operation. As an alternative, or in addition, it is possible, in dependence on a depth to which the stamping part 30 penetrates in the workpiece 9, for the compensating spring 32 to predetermine a prestressing force by which the stamping part 30 presses onto the workpiece 9.

As an alternative to an engraving needle as stamping part 30, the stamping tool 14 can use a countersinking insert. In this case, the compensating spring 32 is dispensed with and the stamping tool is configured to be rigid between the head 29 and the stamping part 30.

As already mentioned above, it is possible for the upper tool part 5*a*, or also the multi-tool 5 in its entirety, to be configured such that it is pivotable or rotatable via a multi-tool pivoting drive 34 about the longitudinal axis 10, which coincides with the axis of the multiple pusher 4. The multi-tool pivoting drive 34 is illustrated schematically in FIG. 2.

The capability of the upper tool part 5*a* to pivot relative to the actuating portion 4*a* of the machine pusher 4 via the drives 11 and 34, on the one hand, makes it possible for the upper tool 12 or 14 to be selected and, in addition, makes it possible for an upper tool which is not rotationally symmetrical about its individual tool axis to be positioned in a pivoted state relative to the workpiece 9. Insofar as the selected upper tool 12 or 14 has a machining contour which is not symmetrical about its longitudinal axis, this relative pivoted positioning can predetermine an angled orientation of said machining contour in relation to the workpiece.

A further drive makes it possible, in principle, for the lower tool part 5*b* to be driven for pivoting or rotation about the longitudinal axis 10 independently of the upper tool part 5*a*. This can be utilized in order to assign a selected lower tool 13 to an upper tool 12. This also makes it possible, in principle, to have an embodiment which has exclusively upper tools which interact with a lower tool, the number of upper tools nevertheless being greater than the number of lower tools. A predetermined lower tool 13 is then assigned to the respectively selected upper tool via a corresponding rotation of the lower tool part 5*b* relative to the upper tool part 5*a* about the longitudinal axis 10.

The invention claimed is:

1. A multi-tool for a punch device, comprising:

an upper tool part with a plurality of upper tools which are activatable from a head side of the multi-tool via a machine pusher of the punch device for workpiece-machining purposes; and a lower tool part with a plurality of lower tools, wherein a workpiece is arrangeable between the upper tool part and the lower tool part, wherein each of the lower tools interacts with an associated one of the upper tools, wherein the number of the upper tools is greater than the number of the lower tools, wherein at least one of the upper tools does not interact with any of the lower tools, and wherein each of the upper tools that does not interact with any of the lower tools projects on the head side of the multi-tool, and in a direction of the machine pusher of the punch device, beyond a remainder of the upper tool part.

2. The multi-tool as claimed in claim 1, wherein each of the upper tools that interacts with a respective one of the lower tools is configured in the form of a punching tool.

3. The multi-tool as claimed in claim 1, wherein each of the upper tools that does not interact with any of the lower tools is configured in the form of a stamping tool.

4. The multi-tool as claimed in claim 1, wherein the plurality of upper tools is arranged to encircle a longitudinal axis of the multi-tool in a circumferential direction, and wherein the at least one upper tool which does not interact with any of the lower tools is arranged circumferentially between two of the upper tools which interact with the associated lower tools.

5. A punch device, comprising:

a machine pusher; and a multi-tool having a head side, the multi-tool comprising an upper tool part comprising a plurality of upper tools which are activatable for workpiece-machining purposes, the upper tools being activatable from the head side of the multi-tool via the machine pusher, and a lower tool part that is located beneath the upper tool part and that comprises a plurality of lower tools, wherein a workpiece is arrangeable between the upper tool part and the lower tool part, wherein each of the lower tools interacts with a dedicated one of the upper tools, wherein the number of the upper tools is greater than the number of the lower tools, wherein at least one of the upper tools does not interact with any of the lower tools, and wherein each of the upper tools that does not interact with any of the lower tools projects on the head side of the multi-tool, and in a direction of the machine pusher of the punch device, beyond a remainder of the upper tool part.

6. The punch device as claimed in claim 5, wherein each of the upper tools that interacts with a respective one of the lower tools is configured in the form of a punching tool.

7. The punch device as claimed in claim 5, wherein each of the upper tools that does not interact with any of the lower tools is configured in the form of a stamping tool.

8. The punch device as claimed in claim 5, wherein the plurality of upper tools is arranged to encircle a longitudinal axis of the multi-tool in a circumferential direction, and wherein the at least one upper tool which does not interact with any of the lower tools is arranged circumferentially between two of the upper tools which interact with the associated lower tools.

9. The punch device as claimed in claim 5, wherein the machine pusher of the punch device interacts simultaneously with a central upper-tool-part pusher and with one of the upper tools on the head side of the multi-tool.

10. The punch device as claimed in claim 9, wherein the central upper-tool-part pusher is supported counter to an actuating direction of the machine pusher via a central pusher spring.

11. The punch device as claimed in claim 9, wherein the upper-tool-part pusher is supported counter to an actuating direction of the machine pusher via a plurality of peripheral pusher springs.

* * * * *